United States Patent [19]

Feinberg

[11] 4,365,655

[45] Dec. 28, 1982

[54] FLAME RETARDANT WOVEN FABRICS

[76] Inventor: Arthur L. Feinberg, R.F.D. 1, Putnam Valley, N.Y.

[21] Appl. No.: 186,832

[22] Filed: Sep. 15, 1980

Related U.S. Application Data

[63] Continuation-in-part of Ser. No. 75,430, Sep. 14, 1979, abandoned, which is a continuation of Ser. No. 955,013, Oct. 26, 1978, abandoned.

[51] Int. Cl.[3] ..... D03D 15/12

[52] U.S. Cl. ..... 139/426 R; 57/904; 428/921

[58] Field of Search ..... 139/383 R, 420 R, 420 C, 139/420 D, 426 R; 57/904; 428/921

[56] References Cited

U.S. PATENT DOCUMENTS

| | | | |
|---|---|---|---|
| 2,542,297 | 2/1951 | Sunbury et al. | 139/420 D |
| 2,712,834 | 7/1955 | Black et al. | 139/426 R |
| 2,741,108 | 4/1956 | Rogosin | 139/420 R |
| 2,816,415 | 12/1977 | Lapdala | 139/420 R |
| 4,001,477 | 1/1977 | Economy et al. | 139/420 R |
| 4,257,221 | 3/1981 | Feinberg | 57/904 X |

FOREIGN PATENT DOCUMENTS

| | | | |
|---|---|---|---|
| 866474 | 4/1961 | United Kingdom | 139/426 R |

*Primary Examiner*—James Kee Chi

*Attorney, Agent, or Firm*—Amster, Rothstein & Engelberg

[57] ABSTRACT

A flame-retardant woven fabric is composed of a warp interwoven with a weft. The threads of the warp contain substantially exclusively staple fibers, and the threads of the weft contain substantially exclusively flame-retardant matrix fibers. The respective thicknesses and densities of the warp and weft threads can be varied so that the matrix fiber content may be varied from about 50% to about 75%, by volume, of the total.

1 Claim, 3 Drawing Figures

FIG. 1
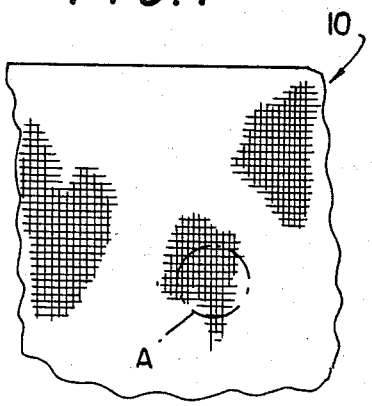
FIG. 2
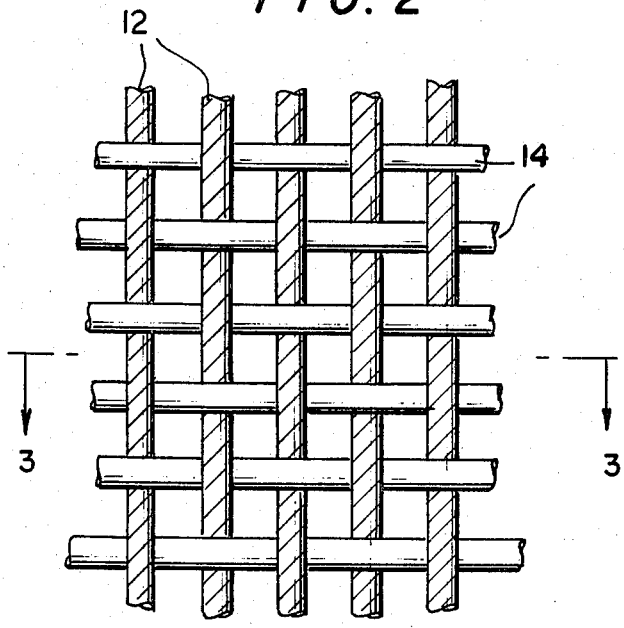
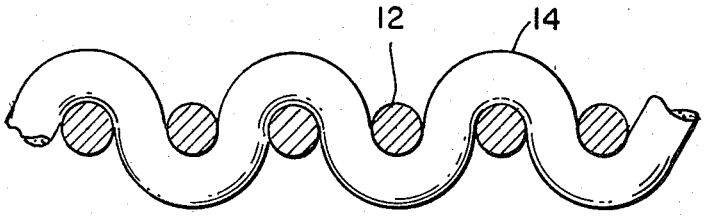
FIG. 3

FLAME RETARDANT WOVEN FABRICS

This application is a continuation-in-part of Application Ser. No. 075,430 filed Sept. 14, 1979 which is in turn a continuation of U.S. patent application No. 955,013 filed Oct. 26, 1978, now both abandoned.

The present invention relates to inherently flame-retardant woven fabrics.

It has recently become a subject of public concern that various items of wearing apparel, for example, children's sleepwear, are highly flammable and expose the wearer to great risk in case of fire. In response to this problem, the Federal Trade Commission has ordered manufacturers of children's sleepwear to produce products which are flame-retardant. Oftentimes, flame-retardancy has been obtained by the chemical treatment of otherwise flammable products. Such treatment methods have been known and appear, for example, in U.S. Pat. Nos. 3,017,292; 3,749,599 and 3,864,156. There has been, however, increasing evidence that such chemical treatment may be deleterious to the wearer, and may, in some cases, produce carcinogenic effects.

Accordingly, a demand has been created for fire resistant fabrics, especially for use in children's sleepwear, that are not treated with potentially dangerous chemical substances and yet still meet or exceed children's sleepwear standards including DOC FF3-71 and DOC FF5-74.

Specifically, standard DOC FF5-74 mandates that for five specimens of a given fabric to be used for children's sleepwear, the average char length shall not exceed 7.0 inches (17.8 cm), that no individual specimen will have a char length greater than 10.0 inches (25.4 cm), and that no individual specimen have a residual flame time greater than 10 seconds. As far as is known, all fabrics which claim to pass DOC FF5-74 exhibit average char lengths of no less than about 4 inches, and all have a residual flame time of at least several seconds.

It is highly desirable that the fabric still meet these criteria after at least 50 launderings such as might be expected during the useful life of the finished garment. Up to now, all known fabrics which are alleged to pass standard DOC FF5-74 prior to laundering do not make the same claim after 50 washings. Further, any fume of which might be given off by the fabric as it burns might be non-toxic, thereby precluding fabrics made of, for example, polyvinyl chloride fiber blends.

Inherently, flame-retardant fibers are well-known to those skilled in the art. These fibers, known as matrix fibers, though useful because of their flame-retardant qualities, are not strong enough to form their own fabrics, tend to have a non-uniform composition, are not susceptible of being easily dyed, and, in general, are not alone suitable for production into piece goods from which finished products, like sleepwear, are formed. On the other hand, conventional natural and synthetic fibers (staple fibers) which are alone suitable for production into finished piece goods, are not inherently flame-retardant.

One known attempted solution to the problem of producing an inherently flame-retardant fabric has been to blend matrix and staple fibers in various proportions. However, conventional techniques for producing blended staple yarns such as disclosed in U.S. Pat. Nos. 3,067,471 and 3,176,351 have not been successfully employed to produce a flame-retardant composite yarn, as far as is known.

Another method for producing untreated flame-retardant fabrics is taught in my co-pending U.S. patent application, Ser. No. 853,314, filed on Nov. 21, 1977, and comprises the steps of separately blowing and carding bundles of matrix and staple fibers and then combining the sliver formed during a common drawing step to produce a blended sliver having desired proportions of matrix and staple fibers. Yet another method of producing untreated flame-retardant fabrics, and the subject of the present invention, is to produce a woven fabric having the desired flame-retardant characteristics.

The production of woven fabrics is known. Weaving is a time-honored and conventional process, which may be performed manually or using automated machinery.

Weaving is essentially the process of interlineating a vertical array of threads known as the warp with a horizontal array of threads known as the weft. The thickness of the threads used in weaving is measured according to European Cotton Count (E.C.C.) designations, which are well-known in the art, and wherein the higher E.C.C. number given to a thread, the thinner it is. Comparative thread density of warp and weft may be varied, and those skilled in the art understand that different textile properties will be obtained depending on the thread thickness and thread density employed.

Conventional weaving techniques have been modified to allow for the use of different threads in the warp as compared to the weft, thus producing desired textile characteristics. For example, U.S. Pat. No. 1,457,892 teaches that a reinforced tire fabric can be created by interweaving a warp of fabric threads with a weft (or woof) including wire stands only. Similar use of warp and weft fibers of different materials to produce fabrics of desired characteristics, especially increased strength, are shown in U.S. Pat. Nos. 2,372,983; 2,466,597; 2,477,407 and 4,048,368. As far as is known, however, the concept of using different warp and weft fabrics has never been employed to create an inherently flame-retardant fabric.

Broadly, it is an object of the present invention to produce an inherently flame-retardant fabric having fibers of cross-sectional uniformity, knitting and weaving reliability, good tensile strength, susceptibility to dyeing and other desirable textile characteristics.

It is also an object of the present invention to produce such an inherently flame-retardant fabric by conventional weaving methods.

It is yet another object of the present invention to produce an inherently flame-retardant woven fabric which does not require the prior blending of matrix and staple fibers.

It is yet another object of the present invention to provide an inherently flame-retardant fabric by a method which is reliable, efficient and convenient to use, and yet is simple and economical in that it uses conventional apparatus and weaving techniques.

In accordance with an illustrative embodiment demonstrating objects and features of the present invention, a flame-retardant fabric is formed by interweaving a warp comprised substantially exclusively of a conventional staple fiber with a weft comprised substantially exclusively of a flame-retardant matrix fiber. Polyester is a particularly suitable staple fiber, and a combination of about 50% vinal and about 50% vinyon is effective as a matrix fiber.

These and other features of the present invention may best be appreciated by reference to a presently preferred, but nontheless illustrative, embodiment as shown in the accompanying drawing, in which:

FIG. 1 is a front elevational view of a fabric constructed according to the present invention;

FIG. 2 is an expanded view of Section A of FIG. 1; and

FIG. 3 is a top plan view of such a fabric.

Turning to the drawing, a fabric constructed in accordance with the present invention is shown generally by the reference numeral 10. Fabric 10 is constructed from warp fiber 12 which is composed substantially exclusively of a conventional staple fiber. Warp 12 is interwoven with a weft composed substantially exclusively of a matrix fiber 14 both as may best be seen by reference to FIG. 2.

In one illustrative embodiment of the present invention, the woven fabric is formed having a warp of 51 threads per inch interwoven with a weft of 40 threads per inch, the threads of the warp being size 28 E.C.C., and the threads of the weft being size 10 E.C.C. The threads of this illustrative woven fabric are single ply. In another illustrative embodiment, the woven fabric is formed having a warp of 50 threads per inch interwoven with a weft of 40 threads per inch, the threads of the warp being size 27 E.C.C. and the threads of the weft being size 10 E.C.C. The threads of this illustrative woven fabric are single ply.

It is emphasized that the respective thicknesses and densities of the warp and weft threads can be varied so as to alter the proportion that the matrix fiber content bears to the total. It has been found, for example, that the matrix fiber content may successfully be varied from about 50%, by volume, of the total content to about 75%, by volume, thereof. This variation is based upon the flame retardancy of the matrix fabric. That is, the higher the flame retardancy of the matrix fabric, the smaller the amount of matrix fabric required.

It has been found that the interweaving of flammable staple fibers with matrix fibers which are inherently flame-retardant produces a woven fabric which is flame-retardant throughout its cross-sectional area. This is an unusual and surprisingly beneficial result, and is particularly unexpected because conventional wisdom would lead one skilled in the art to believe that the flammable staple fibers comprising the warp would catch fire when exposed to flame, even if the weft fibers did not, and that the woven fabric would accordingly begin to decompose.

Accordingly, the fabric formed in accordance with the present invention includes the desirable ease of finishing, good tensile strength, ready susceptibility to dyeing, and other characteristics of the staple fiber while, at the same time, due to the interwoven presence of the matrix fiber, will be flame-retardant.

Without intending to limit the scope of the present invention, the following examples are set forth to demonstrate the unexpected and superior fire resistant characteristics obtained with fabrics manufactured in accordance with the present invention. Standard DOC FF5-74 is incorporated in its entirety by reference herein to support the disclosed data.

EXAMPLE 1

A woven fabric manufactured in accordance with the present invention was evaluated before laundering according to DOC FF5-74 with the following results:
Individual char length of 5 specimens:
2.5 inches, 2.0 inches, 2.6 inches, 3.1 inches, 2.6 inches
Average char length:
2.6 inches
Residual flame time:
Nil

EXAMPLE 2

A woven fabric manufactured in accordance with the present invention was evaluated before laundering according to DOC FF5-74 with the following results:
Individual char length of 5 specimens:
2.5 inches, 2.0 inches, 5.3 inches, 1.5 inches, 2.7 inches
Average char length:
2.8 inches
Residual flame time:
Nil

EXAMPLE 3

A woven fabric manufactured in accordance with the present invention was evaluated before laundering according to DOC FF5-74 with the following results:
Individual char length of 5 specimens:
2.7 inches, 2.3 inches, 1.8 inches, 2.5 inches, 2.7 inches
Average char length:
2.4 inches
Residual flame time:
Nil

EXAMPLE 4

A woven fabric manufactured in accordance with the present invention was evaluated before laundering according to DOC FF5-74 with the following results:
Individual char length of 5 specimens:
1.6 inches, 1.6 inches, 1.9 inches, 1.9 inches, 2.6 inches
Average char length:
1.9 inches
Residual flame time:
Nil

EXAMPLE 5

A woven fabric manufactured in accordance with the present invention was evaluated before laundering according to DOC FF5-74 with the following results:
Individual char length of 5 specimens:
1.9 inches, 1.5 inches, 2.0 inches, 1.6 inches, 2.5 inches
Average char length:
1.9 inches
Residual flame time:
Nil

EXAMPLE 6

A woven fabric manufactured in accordance with the present invention was evaluated before laundering according to DOC FF5-74 with the following results:
Individual char length of 5 specimens:
1.9 inches, 1.8 inches, 2.6 inches, 3.1 inches, 1.8 inches
Average char length:
2.2 inches
Residual flame time:
Nil

What is claimed is:

1. A flame retardant woven fabric comprising a warp interwoven with a weft, the threads of said warp being comprised substantially exclusively of a staple fiber, said staple fiber being polyester, and the threads of said weft being comprised substantially exclusively of a matrix fiber, said matrix fiber being about 50% vinyl and about 50% vinyon, and constituting between 50-75% by volume of the total content of such fabric, said fabric being constructed and arranged to pass standard DOC FF5-74 after 50 launderings.

* * * * *